US005944620A

United States Patent [19]

Elmer

[11] Patent Number: 5,944,620

[45] Date of Patent: Aug. 31, 1999

[54] GOLF CLUB

[76] Inventor: John Clement Elmer, 3 Stormont Ave., Kloof, South Africa, 3610

[21] Appl. No.: 08/958,107

[22] Filed: Oct. 27, 1997

[30] Foreign Application Priority Data

Oct. 31, 1996 [ZA] South Africa ..... 96/9184

[51] Int. Cl.[6] ..... A63B 53/04

[52] U.S. Cl. ..... 473/345; 473/349; 473/327

[58] Field of Search ..... 473/324, 327, 473/345, 346, 349

[56] References Cited

U.S. PATENT DOCUMENTS

| | | | |
|---|---|---|---|
| Re. 34,925 | 5/1995 | McKeighen | 473/345 |
| 2,550,846 | 5/1951 | Milligan | 473/327 |
| 4,431,192 | 2/1984 | Stuff | 473/327 |
| 4,828,265 | 5/1989 | Antonious | 473/327 |
| 4,900,029 | 2/1990 | Sinclair | 473/327 |
| 5,004,241 | 4/1991 | Antonious . | |
| 5,141,230 | 8/1992 | Antonious . | |
| 5,486,000 | 1/1996 | Chorne . | |

*Primary Examiner*—Sebastiano Passaniti
*Attorney, Agent, or Firm*—Nields, Lemack & Dingman

[57] ABSTRACT

A metal wood head for a golf club comprises an integrated hollow body formed of titanium, or another like light metal material. The front wall of the body has a top edge that defines a concave profile between opposite ends thereof, the top wall of the body, which extends from the top edge of the front wall, defining a corresponding channel formation extending from the front wall to a rear wall of the body. This top wall profile of the metal wood head provides for a body mass distribution, relative to the centre of mass of the body, which will induce an improved flight path for golf balls struck by a metal wood including this head.

8 Claims, 2 Drawing Sheets

GOLF CLUB

THIS INVENTION relates to a golf club.

BACKGROUND OF THE INVENTION

A set of golf clubs conventionally includes a group of clubs known as woods, a group of clubs known as irons and a putter. The present invention relates particularly to the group of clubs known as woods and, more particularly, to woods of the type commonly referred to as metal woods.

A metal wood comprises a head formed of a metal material and a shaft which is secured to and which extends from the head, the head defining a receiving formation, commonly referred to as a hosel, within which an end of the shaft is secured. The shaft can be formed of any one of a range of materials and as this does not form part of the present invention, this is not described in further detail herein.

A metal wood head comprises an integrated hollow body having a front wall defining a front face of the head, known as the striking face of the head, which extends between opposite ends of the body, known as the heel and toe ends of the body, and between a base wall of the body, known as the sole of the body, and a top wall of the body. The sole and the top wall extend operatively rearwardly from the operative bottom and top edges, respectively, of the front wall and are joined to one another by a rear wall disposed at a spaced location operatively rearwardly of the striking face, thereby forming the hollow structure that optionally can be filled with a light weight foam material. A receiving formation for a golf club shaft is defined integrally as part of the body near the heel end thereof. This general construction of a metal wood head is well known and as this does not form part of the present invention, this is not described in further detail herein. Also, any reference hereinafter to a metal wood head must be interpreted as a reference to a head of the above general type.

The technology associated with the design of metal woods has continuously evolved, both in relation to the actual design of the heads and in relation to materials used. Different design parameters are associated with the use of different materials, while the level of accomplishment of a golfer intended to use a particular metal wood also must be taken into account in the design of the metal wood.

It will be understood that the main objectives of the design of a metal wood head are that it must allow a golfer to hit a golf ball the longest possible distance with the maximum possible accuracy and consistency. The distance that a golf ball is hit is largely determined by the speed at which a golfer can displace the head of his golf club during impact, with the other determining factor in distance being the flight path of the golf ball. Accuracy, which is linked to consistency, is determined by various factors which include the location on the striking face of a golf club head where a golf ball is struck. The striking face defines a "sweet spot" which is a region within which a golf ball should be struck and a current objective with golf club head design is to provide for the largest possible "sweet spot". Larger "sweet spots" are currently associated with larger golf club heads and lighter materials, titanium being a typical example of such a material which is now commonly used for forming the heads of metal woods. Any reference hereinafter to a metal wood having a head of a light metal material must accordingly be interpreted as a reference to a wood of the above type. Such a metal wood will thus include a head of a material such as titanium, or any other material or composite material which may include a metal, a synthetic plastics, or any other material, either separately or in combination, which is suitable and which may only be developed in the future. Any reference herein to a light metal material must be interpreted as such.

Because of the weight and strength and impact qualities of, for example, titanium, it has become possible to make a metal wood head larger, thereby creating a larger "sweet spot" area defined within the perimeter of the striking face of such a metal wood head, where a golf ball can be struck with relative consistency, without making the head heavier and thus slowing down the speed at which a golfer can displace the head during impact with a golf ball. Although a golfer is thus enabled to displace his golf club head at a speed normal to himself and to strike a golf ball with more consistency, known metal woods having such larger heads do not generally induce a satisfactory flight path for a golf ball and at least some of the benefits of using lighter metals as envisaged are thus forfeited. More particularly, in relation to such metal wood heads formed of light metal materials, it is required to make the sole of the head thicker than the remainder of the body of the head, thus providing for a mass concentration beneath the centre of percussion or centre of mass of the head, which will induce a golf ball to fly too high. The centre of percussion of the head of a metal wood represents the ideal position on the striking face of the head where a ball should be struck, this position coinciding with a line passing through the centre of mass of the head and extending perpendicularly to the striking face. The "sweet spot" on the striking face is an enlarged area defined by the striking face around the centre of percussion, where a ball can be struck with relative consistency.

In relation to more traditional metal woods having heads made of heavier metals, it has been attempted to provide a satisfactory flight path for a golf ball by concentrating the mass of the head in predetermined regions of the head. For example, U.S. Pat. No. 5,004,251 granted to Antonious provides for a mass concentration within a top wall region of the club head immediately above the centre of percussion of the head which, it is suggested, provides for a truer flight path if a ball is properly struck. U.S. Pat. No. 5,141,240, also granted to Antonious, in addition provides for a mass concentration within the striking face of the head in the region of the centre of percussion defined by the striking face and optionally also for mass concentrations extending rearwardly within the club head body either immediately behind the centre of percussion or on each side of the centre of percussion. Again it is suggested that such a mass arrangement will provide for a truer flight path for a ball when properly struck. In addition, it is suggested in both the above patents to define a slot in the top wall of the head above the centre of percussion, but it is stressed that this is proposed merely to enhance the aero-dynamic qualities of the club for improving club head stability while swinging the club. The mass concentrations as proposed clearly will override any effect that the formation of the said slots could have in relation to the distribution of mass within the golf club heads relative to their centre of percussion.

Insofar as the above proposals in relation to the distribution of mass within metal wood heads could enhance the flight path characteristics of a golf ball struck with such metal woods, the proposals could not be applied to the design of metal wood heads to be formed of lighter metals such as titanium, which permit the mass of heads to be maintained while the size of heads are enlarged. Particularly, the design parameters associated with the metal wood heads disclosed in the above U.S. patents cannot apply to the design of larger heads of lighter materials in order to improve the ball flight characteristics of balls struck with such larger heads.

As such, it is an object of this invention to establish design parameters for improving the ball flight characteristics associated with metal woods having heads formed of light metals, e.g. titanium, and the like.

It is a further object of this invention to provide a metal wood head formed of a light metal material which is designed to induce an improved flight path for a golf ball when properly struck, particularly when compared with the flight path of golf balls struck with known metal wood heads of the type which are formed of light metals.

BRIEF SUMMARY OF THE INVENTION

According to the invention there is provided a metal wood head which is formed of a light metal material of a type including titanium, the head comprising an integrated hollow body which has a front wall defining a striking face and having a top edge and a bottom edge, a top wall and a sole extending operatively rearwardly from the top edge and the bottom edge, respectively, of the front wall and a rear wall which joins the top wall and the sole at a spaced location operatively rearwardly of the front wall, the hollow body defining a toe end and a heel end and a receiving formation for a golf club shaft at the said heel end thereof, the top edge of the front wall of the hollow body defining a concave profile extending operatively upwardly from a central location between the toe end and the heel end of the body towards the toe end and the heel end of the body with the said top edge at the toe end and the heel end being disposed at least 3 mm above the top edge at the said central location and the top wall of the hollow body defining a rearwardly extending channel formation as it extends rearwardly from the top edge of the front wall towards the rear wall of the body.

The concave profile of the top edge of the front wall particularly provides for the top edge of the front wall at the toe end and the heel end of the body to be disposed at least 7 mm above the top edge of the front wall at the said central location of the front wall. Also, the cross-sectional profile of the channel formation defined by the top wall of the hollow body may coincide substantially with the concave profile defined by the front wall of the hollow body.

Still further, the striking face defined by the front wall of the hollow body defines a centre of percussion and the said central location along the top edge of the front wall from where the top edge is profiled to extend operatively upwardly may be disposed operatively above the centre of percussion.

The invention extends also to a metal wood, which comprises a metal wood head which is formed of a light metal material of the type including titanium, the head comprising an integrated body which has a front wall defining a striking face and having a top edge and a bottom edge, a top wall and a sole extending operatively rearwardly from the top edge and the bottom edge, respectively, of the front wall and a rear wall which joins the top wall and the sole at a spaced location operatively rearwardly of the front wall, the hollow body defining a toe end and a heel end and a receiving formation for a golf club shaft at the said heel end thereof, the top edge of the front wall of the hollow body defining a concave profile extending operatively upwardly from a central location between the toe end and the heel end of the body towards the toe end and the heel end of the body with the said top edge at the toe end and the heel end being disposed at least 3 mm above the top edge at the said central location and the top wall of the hollow body defining a rearwardly extending channel formation as it extends rearwardly from the top edge of the front wall towards the rear wall of the body; and a golf club shaft having one end received within the receiving formation defined therefor by the hollow body and being secured to the hollow body.

The metal wood head of this metal wood particularly may incorporate all the features of the metal wood head in accordance with the present invention.

Further features of the metal wood head of the invention, including a description of the technical advantages associated with this metal wood head, are described hereinafter, by way of example, with reference to the accompanying diagrammatic drawings. In the drawings:

DETAILED DESCRIPTION OF THE INVENTION

Figure 1:
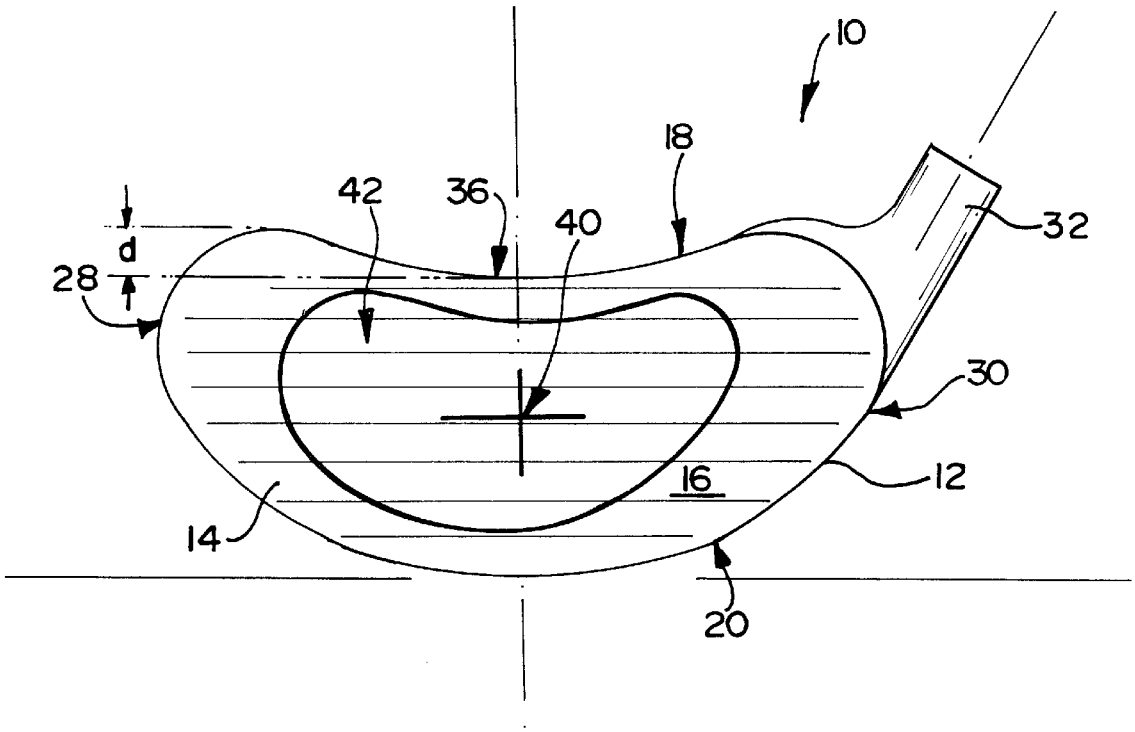
FIG. 1 shows a front view of a metal wood head, in accordance with the invention.

Referring to the drawings, a metal wood head, in accordance with the invention, is designated generally by the reference numeral 10. The metal wood head 10 is formed of titanium, which is a form of light metal material which has suitable strength and impact qualities that enable the formation of larger metal wood heads without rendering such heads heavier, particularly when compared with more conventional metal wood heads.

The metal wood head 10 comprises in general an integrated hollow body 12 which has a front wall 14 defining a striking face 16 and having a top edge 18 and a bottom edge 20. A top wall 22 extends operatively rearwardly from the top edge 18 of the front wall 14, whereas a sole 24 extends operatively rearwardly from the bottom edge 20 of the front wall 14, a rear wall 26 effectively joining the top wall 22 and the sole 24 at a spaced location operatively rearwardly of the front wall 14. The front wall 14, the top wall 22, the sole 24 and the rear wall 26 are integrated with one another to form the hollow body 12 in the configuration as illustrated.

Figure 3:
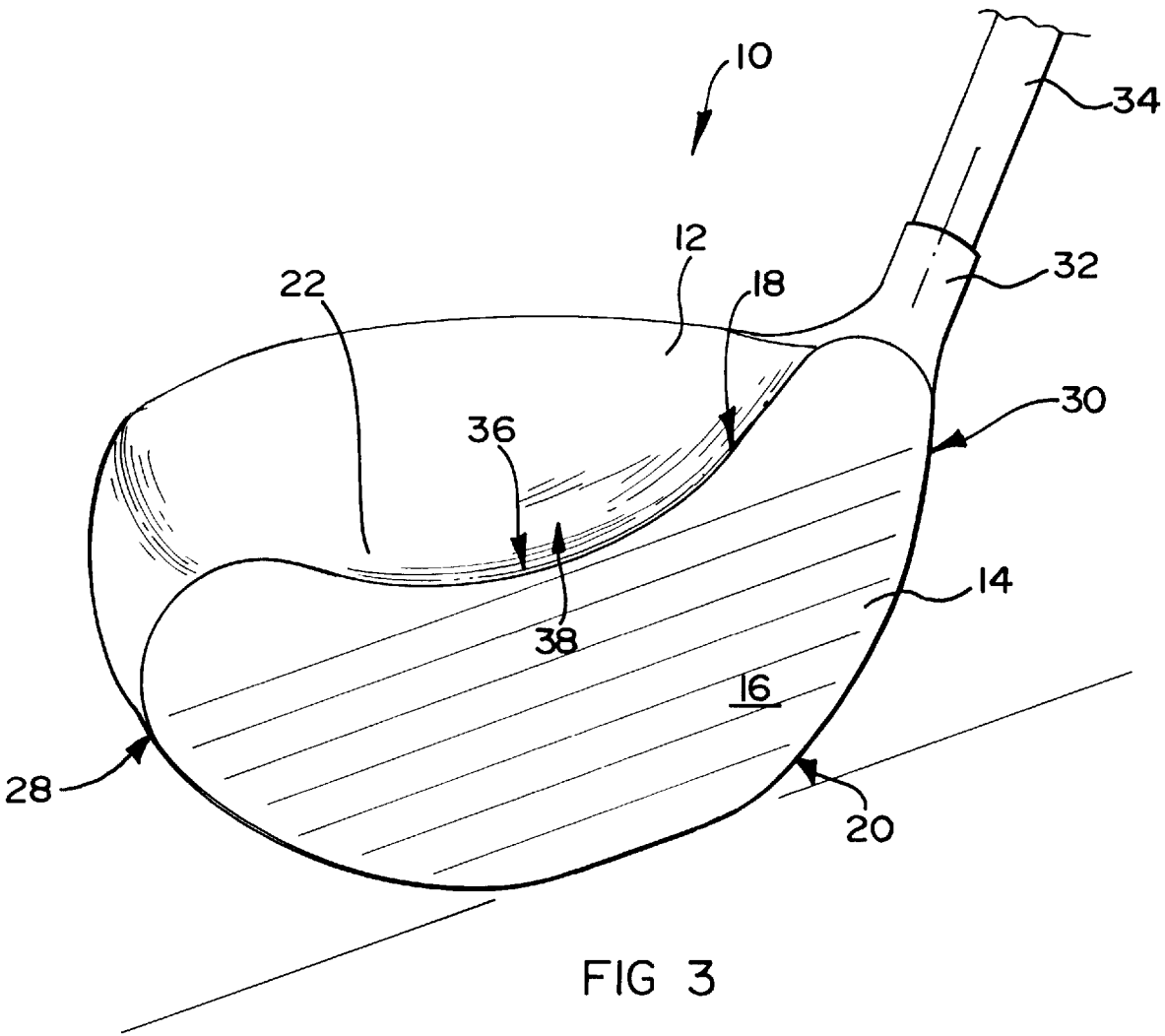
FIG. 3 shows a three-dimensional view of the metal wood head of FIG. 1.

The hollow body 12 defines a toe end 28 and a heel end 30, a receiving formation 32 being defined by the hollow body at its heel end 30 whereby a golf club shaft 34 (see FIG. 3) can be secured to the metal wood head 10, for forming a complete metal wood.

Figure 2:
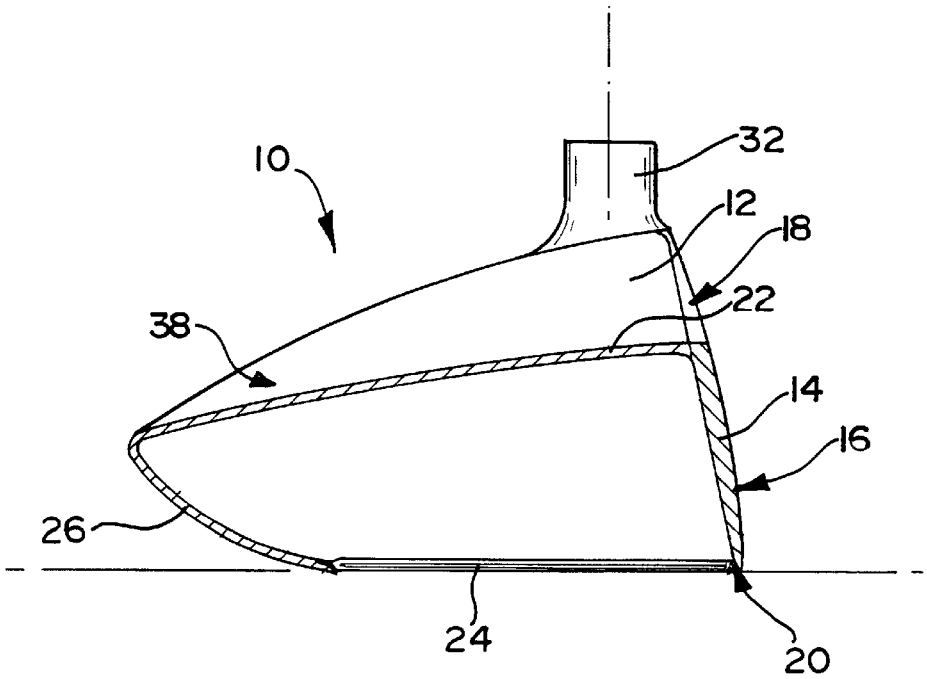
FIG. 2 shows a cross-sectional side view of the metal wood head of FIG. 1.

The top edge 18 of the front wall 14 of the hollow body 12 defines a concave profile extending operatively upwardly from a central location 36 between the toe end 28 and the heel end 30 of the body 12 towards the toe end and the heel end. The extent of the concavity as represented by the dimension "d" in FIG. 1 is at least 3 mm, and typically at least 7 mm. As such, the top edge at the toe end 28 and the heel end 30 is disposed at least 3 mm, and typically at least 7 mm, above the top edge at the said central location 36. Accordingly, the top wall 22 defines a rearwardly extending channel formation 38 as it extends rearwardly from the top edge 18 of the front wall 14, the channel formation 38 extending from the front wall 14 to the rear wall 26 of the hollow body 12, as is illustrated clearly in FIGS. 2 and 3 of the drawings.

It will be appreciated that the exact design of the hollow body 12, including particularly the curvature of the respective walls thereof is such that the hollow body 12 is provided with suitable strength and rigidity qualities in order to permit its use as a metal wood head for striking a golf ball. It is envisaged accordingly that the individual walls of the hollow body 12 may be provided with different thickness profiles, the thickness of the sole 24 of the hollow body 12 typically being thicker than the remaining walls, insofar as this sole will be commonly exposed to impact with the ground, and objects lying on the ground, to which the remaining walls of the body 12 will not be ordinarily exposed. In this regard the wall thicknesses of the respective walls forming the hollow body 12 will be essentially conventional as for known metal wood heads formed of light metal materials of the type herein envisaged.

Referring particularly to FIG. 1 of the drawings, the striking face 16 defined by the front wall 14 of the hollow body 12 defines a centre of percussion 40, which constitutes the impact point where a golf ball should be ideally struck with the metal wood head 10 when forming part of a complete golf club, the centre of percussion 40 coinciding substantially with a line which extends through the centre of mass of the metal wood head 10 perpendicularly with respect to the striking face 16.

The effective height of the metal wood head 10 in the region of the central location 36 is conventional as for known metal wood heads of the type, whereas the raised regions on either side of this central location, resulting from the concave profile of the top edge 18 of the front wall 14, will in effect provide for additional material being utilised within the hollow body 12 on either side of the centre of percussion 40 and also at a raised level above the centre of percussion.

Because of the hollow structure of the hollow body 12 which, in effect, provides for perimeter weighting around the centre of percussion 40, the raised profile of the body 12 as shown in effect provides for mass concentrations at transversely spaced locations from the centre of percussion 40, as well as at a raised level above the centre of percussion 40 and it is submitted that thereby the flight path profile of a ball struck by the metal wood head 14 will be effectively enhanced in order to maximise hitting distances.

Furthermore, as is commonly associated with light metal metal wood heads which, because of the perimeter weighting envisaged above, define a relatively large "sweet spot" within which a golf ball can be struck with relative consistency, the "sweet spot" associated with the metal wood head 10 and defined within the region 42 of the striking face 16 also is effectively enlarged, thus enhancing the potential consistency with which a golf ball can be struck with a golf club incorporating the metal wood head 10.

It will be understood that by providing for raised body regions within the hollow body 12 forming the metal wood head 10 at transversely spaced locations from the centre of percussion as defined, the effect of the mass concentration operatively beneath the centre of percussion resulting from the relatively thick sole of the body 12, which will ordinarily cause golf balls to be hit too high, will be effectively negated. The profile of the head 10 as defined thus provides for golf balls to be hit along a relatively lower trajectory and also with reduced underspin, resulting in a golf ball travelling further. Also, because mass concentrations are provided at transversely spaced locations from the centre of percussion of the metal wood head 10, a golf ball struck at a transversely spaced location from the centre of percussion 40 will not unduly deviate from its intended flight path, particularly due to the effective perimeter weighting that is created by the profile of the head 10. The theory associated with this benefit is already well known and does not require further explanation herein.

The principles of the present invention as hereinabove defined and described accordingly provides for an improved flight path for a golf ball struck with a metal wood having a relatively large light metal head, particularly when compared with the flight path of golf balls struck with known metal wood heads formed of light metals and having a relatively large head. In effect the flight distance of a golf ball before landing is increased while additional roll of the golf ball after landing also is induced.

These principles also enhance the consistency with which golf balls can be struck, these benefits in combination in effect improving the proficiency of a golfer.

I claim:

1. A metal wood head which is formed of a light metal material of a type including titanium, the head comprising an integrated hollow body forming an enclosed space, said hollow body comprising a front wall defining a striking face and having a top edge and a bottom edge, a top wall and a sole extending operatively rearwardly from the top edge and the bottom edge, respectively, of the front wall and a rear wall which joins the top wall and the sole at a spaced location operatively rearwardly of the front wall, the hollow body defining a toe end and a heel end and a receiving formation for a golf club shaft at said heel end thereof, the top edge of the front wall of the hollow body defining a concave profile extending operatively upwardly from a central location between the toe end and the heel end of the body towards the toe end and the heel end of the body with said top edge at the toe end and the heel end being disposed at least 3 mm above the top edge at said central location and the top wall of the hollow body defining a rearwardly extending channel formation as it extends rearwardly from the top edge of the front wall towards the rear wall of the body, providing a material mass distribution within the body in which additional mass is concentrated at transversely spaced, raised locations with respect to said central location.

2. A metal wood head as claimed in claim 1, in which the concave profile of the top edge of the front wall provides for the top edge of the front wall at the toe end and the heel end of the body to be disposed at least 7 mm above the top edge of the front wall at said central location of the front wall.

3. A metal wood as claimed in claim 1, in which the cross-sectional profile of the channel formation defined by the top wall of the hollow body coincides substantially with the concave profile defined by the front wall of the hollow body.

4. A metal wood head as claimed in claim 1, in which the striking face defined by the front wall of the hollow body defines a center of percussion and said central location along the top edge of the front wall from where the top edge is profiled to extend operatively upwardly is disposed operatively above the center of percussion.

5. A metal wood, which comprises a metal wood head which is formed of a light metal material of a type including titanium, the head comprising an integrated hollow body forming an enclosed space, said hollow body comprising a front wall defining a striking face and having a top edge and a bottom edge, a top wall and a sole extending operatively rearwardly from the top edge and the bottom edge, respectively, of the front wall and a rear wall which joins the top wall and the sole at a spaced location operatively rearwardly of the front wall, the hollow body defining a toe end and a heel end and a receiving formation for a golf club shaft at said heel end thereof, the top edge of the front wall of the hollow body defining a concave profile extending operatively upwardly from a central location between the toe end and the heel end of the body towards the toe end and the heel end of the body with said top edge at the toe end and the heel end being disposed at least 3 mm above the top edge at said central location and the top wall of the hollow body defining a rearwardly extending channel formation as it extends rearwardly from the top edge of the front wall towards the rear wall of the body, providing a material mass distribution within the body in which additional mass is concentrated at transversely spaced, raised locations with respect to said central location; and a golf club shaft having one end received within the receiving formation defined therefor by the hollow body and being secured to the hollow body.

6. A metal wood as claimed in claim 5, in which the concave profile of the top edge of the front wall of the hollow body provides for the top edge at the toe end and the heel end of the body to be disposed at least 7 mm above the top edge of the front wall at said central location of the front wall.

7. A metal wood as claimed in claim 5, in which the cross-sectional profile of the channel formation defined by the top wall of the hollow body coincides substantially with the concave profile defined by the front wall of the hollow body.

8. A metal wood as claimed in claim 5, in which the striking face defined by the front wall of the hollow body defines a center of percussion and said central location along the top edge of the front wall from where the front wall is profiled to extend operatively upwardly is disposed operatively above the center of percussion.

* * * * *